US007941999B2

(12) United States Patent
Kasper et al.

(10) Patent No.: US 7,941,999 B2
(45) Date of Patent: May 17, 2011

(54) INTERNAL COMBUSTION ENGINE

(75) Inventors: Werner Kasper, Friedrichshafen (DE); Rolf Traub, Oberteuringen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 625 days.

(21) Appl. No.: 12/069,398

(22) Filed: Feb. 8, 2008

(65) Prior Publication Data

US 2008/0216475 A1 Sep. 11, 2008

(30) Foreign Application Priority Data

Mar. 9, 2007 (DE) ..... 10 2007 011 680

(51) Int. Cl.
*F02B 33/44* (2006.01)
*F02B 37/00* (2006.01)
*F02M 25/07* (2006.01)

(52) U.S. Cl. ..... 60/605.2; 60/612; 123/568.11; 123/568.12

(58) Field of Classification Search ..... 60/612, 60/605.2; 123/568.11, 568.12; *F02M 25/07; F02B 37/00*
See application file for complete search history.

(56) References Cited

U.S. PATENT DOCUMENTS

| | | | | |
|---|---|---|---|---|
| 4,249,382 | A | 2/1981 | Evans et al. | 60/605.2 |
| 5,517,976 | A * | 5/1996 | Bachle et al. | 60/605.2 |
| 6,752,132 | B2 * | 6/2004 | Remmels et al. | 123/568.11 |
| 7,165,403 | B2 * | 1/2007 | Sun et al. | 60/605.2 |
| 2005/0274366 | A1 * | 12/2005 | Sato | 60/605.2 |
| 2006/0174621 | A1 * | 8/2006 | Chen et al. | 60/612 |
| 2010/0024416 | A1 * | 2/2010 | Gladden et al. | 60/605.2 |
| 2010/0077747 | A1 * | 4/2010 | Pierpont et al. | 60/605.2 |

FOREIGN PATENT DOCUMENTS

| | | | |
|---|---|---|---|
| DE | 10 2004 015 018 | | 10/2005 |
| DE | 10 2005 018 221 | | 10/2006 |
| JP | 07293262 | A * | 11/1995 |

OTHER PUBLICATIONS

Machine Translation of DE 10 2005 018 221 A1, published on Oct. 26, 2006.*

* cited by examiner

*Primary Examiner* — Thai Ba Trieu
(74) *Attorney, Agent, or Firm* — Klaus J. Bach

(57) ABSTRACT

In an internal combustion engine with at least one turbocharger supplying compressed air to the engine cylinders which are divided into a first group and a second group, a first exhaust gas line connecting a first section of an exhaust gas collection line to the turbine, a recirculation line for returning exhaust gas from a second section of the exhaust gas collection line to the charge air supply line, a first control device controls the exhaust gas flow from a section of the cylinders to the first section of the exhaust gas collection line, a second control device controls the exhaust gas flow to the turbine and a third control device controls the exhaust gas flow recirculated to the charge air supply line for the cylinder.

8 Claims, 3 Drawing Sheets

INTERNAL COMBUSTION ENGINE

BACKGROUND OF THE INVENTION

The invention relates to a supercharged internal combustion engine with exhaust gas recirculation and a first group of cylinders and a second group of cylinders which operates in accordance with the spender cylinder principle wherein specifically exhaust gas from the second group of cylinders is recirculated. The engine includes an exhaust gas collection duct having a first section connected to the first group of cylinders and a second section connected to the second group of cylinders for receiving exhaust gas therefrom and conducting it to the turbine or, respectively, via an exhaust gas recirculation line, to a charge air line supplying fresh gas to the cylinders.

An internal combustion engine with these features is disclosed in U.S. Pat. No. 4,249,382. In a first embodiment, an internal combustion engine with six cylinders and an exhaust gas turbocharger is shown wherein one cylinder is used as a recirculation exhaust gas supply cylinder (spender cylinder). The exhaust gas of the other cylinders is combined in a first section of the exhaust gas collection line and is supplied via an exhaust gas collection line to the turbine of the exhaust gas turbocharger. The exhaust gas of the recirculation exhaust gas supply cylinder is collected in a second section of the exhaust duct and is returned, via an exhaust gas recirculation cooler to the charge air intake duct. With this arrangement, a constant exhaust gas recirculation rate of 16% is provided.

In the arrangement described in following description more than one cylinder can be used for returning exhaust gas to the intake duct or directing it, selectively to the turbine.

In a second embodiment of the state of the art referred to above, the first and the second groups of cylinders comprise each the same number of cylinders. Additionally, at the point of connection to the exhaust recirculation line there is a branch off line leading to the first exhaust gas line. The branch-off line includes an electrical control device by which the exhaust gas flow from the exhaust gas recirculation line to the first exhaust gas line can be controlled.

With this design, a maximum exhaust gas recirculation rate of 50% is obtainable. Because of the higher exhaust gas back pressure in the exhaust gas recirculation line an exhaust gas recirculation supply cylinder has to perform a greater exhaust gas discharge work which results in a higher fuel consumption and a higher thermal load. This applies particularly to high-pressure exhaust gas recirculation as it is required for supercharged engines. With exhaust gas recirculation rates of for example 20% in this arrangement, 50% of the cylinders are operated with an increased exhaust gas back pressure which has a detrimental effect on the fuel consumption. In practice, it is attempted to find a compromise between, on one hand, the necessary exhaust gas recirculation rate and consequently, the number of cylinders in the second group of cylinders and, on the other hand, the fuel consumption. A further disadvantage of the second embodiment described above resides in the fact that an exhaust gas recirculation rate of 0% cannot be established over the whole operating range, for example, when the pressure level in the charge air supply line is lower than the pressure level in the second exhaust gas line.

It is the object of the present invention to provide a supercharged internal combustion engine with exhaust gas recirculation, which includes a first cylinder group and a second cylinder group for which an exhaust gas recirculation rate of 0% can be set over a large operating range and the second cylinder group always includes only a minimum number of cylinders.

SUMMARY OF THE INVENTION

In an internal combustion engine with at least one turbocharger including a compressor and a turbine, a charge air supply line for supplying compressed air from the compressor to the engine cylinders which are divided into a first group and a second group, an exhaust gas collection line having a first section connected to the first group of cylinders and a second section connected to the second group of cylinders, a first exhaust gas line which connects the first section of the exhaust gas collection line to the turbine, a recirculation line for returning exhaust gas from the second section of the exhaust gas collection line to the charge air supply line, and a first control device for controlling the exhaust gas flow from the second section to the first section of the exhaust gas collection line, a second control device is arranged in the first exhaust gas line for controlling the exhaust gas flow to the turbine and a third control device is arranged in the exhaust gas recirculation line for controlling the exhaust gas flow recirculated to the charge air supply line.

For large exhaust gas recirculation rates of for example 50%, the exhaust gas spender cylinder concept is combined with a high pressure exhaust gas recirculation arrangement. To this end, the internal combustion engine comprises, in addition to the control arrangement known from the state of the art by which the exhaust gas flow between the two sections of the exhaust gas collection line is determined, a second and a third control device. The second control device is arranged in the first exhaust gas line, which interconnects the first section of the exhaust gas collection line of the first cylinder group and the turbine of the exhaust gas turbocharger. By way of the second control device, the exhaust gas of the first cylinder group can be backed up. The backed-up exhaust gas than flows via the first control device to the second section of the exhaust gas collection line to which the exhaust gas from the second cylinder group is directed (spender cylinder), whereby the exhaust gas recirculation rate is increased. The third control device is arranged in the exhaust gas recirculation line which connects the second section of the exhaust gas collection line of the second cylinder group to the charge air supply line. By the third control device, the recirculation line can be closed, that is, an exhaust gas recirculation rate of 0% is provided.

A control device in the sense of the invention is an electrically mechanically or pneumatically operable control valve whose setting is determined by an electronic engine control unit via performance graphs depending on engine speed power output or ambient conditions. Ambient conditions are barometric pressure intake air temperature and operating state of the internal combustion engine, here meaning either a transient or stationary engine operation.

Using the three control devices, three different types of operation can be established: In the first type, an exhaust gas recirculation rate of 0% is provided and the exhaust gas of the second cylinder group is supplied to the first section of the exhaust gas collection line. Since now all of the exhaust gas is available for driving the turbocharger, the charging of the cylinders and the acceleration behavior of the supercharged internal combustion engine is improved; for example, in connection with an internal combustion engine-generator unit, this is advantageously used during a load increase.

In the second type of operation the exhaust gas recirculation rate is adjusted to a value in the area between zero and a certain limit value which is determined by the ratio of the number of cylinders in the second cylinder group and the total number of cylinders of the internal combustion engine. If the engine comprises for example sixteen cylinders and the first cylinder group comprises thirteen cylinder and the second cylinder group comprises three cylinders, the limit value for the exhaust gas recirculation rate is calculated as 19%. In the practice, this exhaust gas recirculation rate is set during normal operation above a predetermined power output value for example at an average pressure of 6 bar.

In the third type of operation, an exhaust gas recirculation rate exceeding the limit value is set, for example, up to 50%. The third type of operation permits an HCCI operation of the internal combustion engine.

In a particular embodiment of the invention, for an internal combustion engine with V-shaped cylinder arrangement a first cylinder bank (A-bank) includes cylinders of the first and the second group and the second cylinder bank (B-bank) includes only cylinders of the first group of cylinders. In this embodiment, then the exhaust gas collection line of the second cylinder bank is directly and exclusively connected to the turbine of the exhaust gas turbocharger via a second exhaust gas line. To prevent non-uniform loading a compensation line extending between the two exhaust gas lines of the two cylinder banks is provided.

In one alternative embodiment, the exhaust gas collection line of the second cylinder bank is in communication, via the second exhaust gas line, with the turbine and a fourth control device is arranged in the second exhaust gas line for controlling the exhaust gas flow while the exhaust gas collection line of the second cylinder bank (B-bank) is additionally in communication with the exhaust gas recirculation line via a connecting line which includes a throttle.

Preferred embodiments of the invention will be described below on the basis of the accompanying drawings.

DESCRIPTION OF THE PREFERRED EMBODIMENTS

Figure 1:
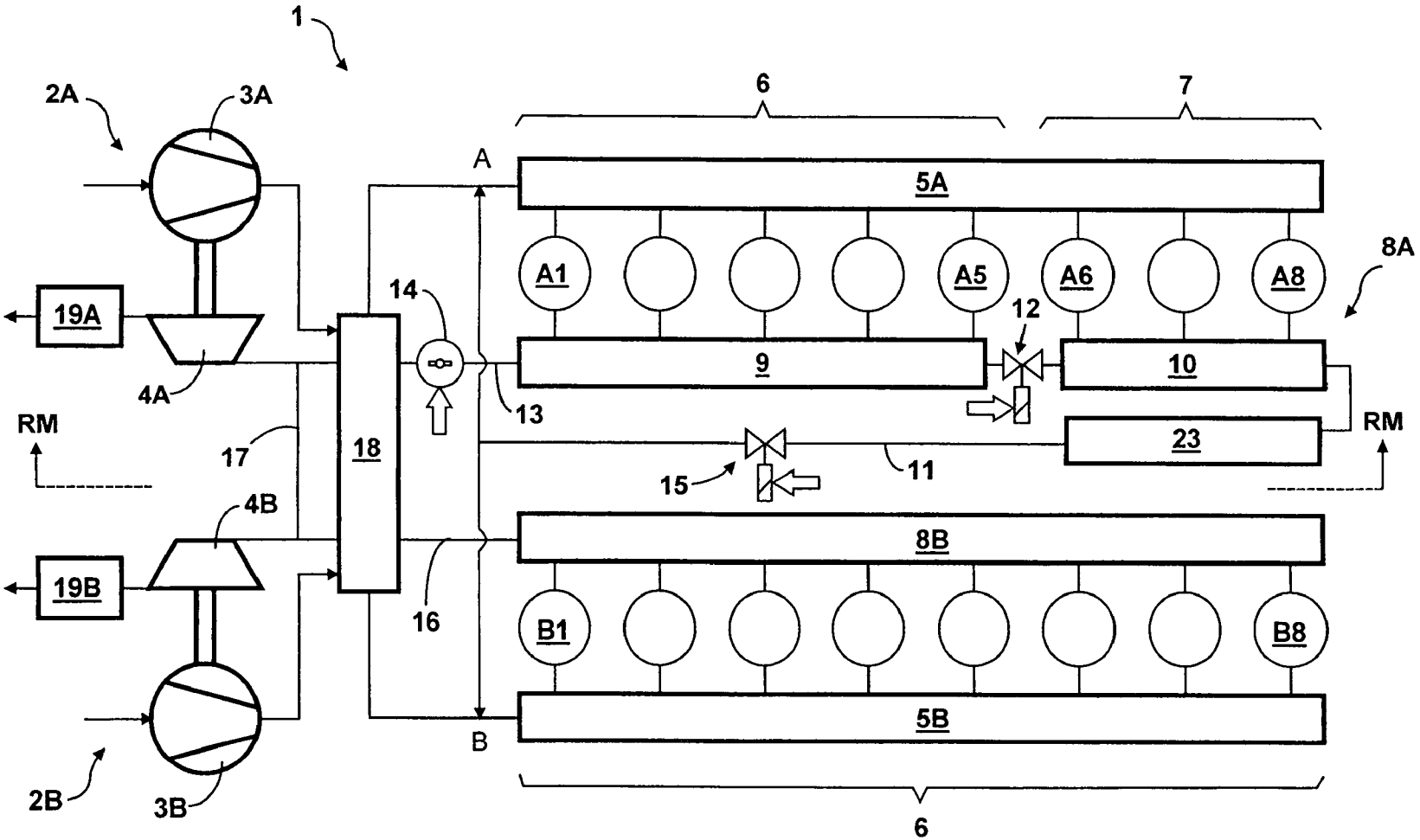
FIG. 1 shows a first embodiment of the internal combustion engine according to the invention.

FIG. 1 shows in a block diagram a first embodiment of the invention. It shows an internal combustion engine in a V-arrangement with a first cylinder bank A1 to A8 and a second cylinder bank B1 to B8. The first cylinder bank A1 to A8 is provided with the following components: an exhaust gas turbocharger 2A with a compressor 3A and a turbine 4A, a charge air cooler 18, a charge air supply line 5A for supplying compressed air, an exhaust gas collection line 8A comprising a first section 9 and a second section 10 and a muffler with a particle filter 19A. The second cylinder bank B1 to B8 is provided with the following components: an exhaust gas turbocharger 2B with a compressor 3B and a turbine 4B, the charge air cooler 18, a charger air supply line 5B, an exhaust gas collection line 8B and a muffler with a particle filter 19B.

The first cylinder bank A1 to A8 comprises a first cylinder group 6 and a second cylinder group 7. The first cylinder group 6 comprises the cylinders A1 to A5 whose exhaust gases are collected in the first section 9 of the exhaust gas collection line 8A. The second cylinder group 7 includes the cylinders A6 to A8 the exhaust gases of which are collected in the second section 10 of the exhaust gas collection line 8A. The second cylinder group 7 operates in accordance with the spender cylinder principle. By way of a first exhaust gas line 13, the exhaust gas is supplied to the turbine 4A of the turbocharger 2A. For the exhaust gas recirculation, an exhaust gas recirculation line 11 is provided, which is connected to the charge air supply lines 5A and 5B downstream of the charge air cooler 18 at the connecting points A and B. In the recirculation line 11, a heat exchanger 23 is arranged. The second cylinder bank B1 to B8 comprises exclusively cylinders of the first cylinder group 6. Their exhaust gases are collected together in the exhaust gas collection line 8B and conducted to the turbine 4B of the exhaust gas turbocharger 2B via a second exhaust gas line 16. The second cylinder bank B1 to B8 therefore does not contribute to the exhaust gas recirculation. Via a compensation line 17 however, a compensation between the exhaust gas flows can be achieved ahead of the turbines 4A and, respectively, 4B of the two exhaust gas turbochargers 2A and 2B can be achieved.

For setting the exhaust gas recirculation rate, three control devices 12, 14 and 15 are provided. A control device herein is to be understood to be an electrically, mechanically or pneumatically operated control arrangement whose setting is determined by an electronic engine control unit via performance graphs depending on engine operating parameters such as engine speed, engine power output, intake air temperature and operating state of the internal combustion engine, that is, in this case, a transient or stationary operating state. The control device 12 may also be in the form of fixed throttle whereby the construction expenditures are reduced. Further explanations of features shown in FIG. 1 will be described with reference also to FIG. 3 which shows an exhaust gas recirculation performance graph in which on the base the engine speed nMOT is indicated and on the ordinate the power output of the internal combustion engine is plotted.

The arrangement has the following functions:

In a first operating mode, an exhaust gas recirculation rate AGRR of zero is set by the electronic engine control unit, for example, during start-up operation of an internal combustion engine-generator arrangement which is provided as an emergency power supply unit. In the first operational phase, the first control device 12 is deactivated (normally open) so that the exhaust gas can flow, without restriction, from the second section 10 of the exhaust gas collection line 8A to the first section 9 thereof. The second control device 14 is also deactivated (normally open) so that the exhaust gas can flow from the exhaust gas collection line 8A of the first cylinder bank A1 to A8 without restriction to the turbine 4A of the exhaust gas turbocharger 2A. The third control device 15 is also deactivated (normally closed) whereby the exhaust gas recirculation line 11 is blocked.

Figure 3:
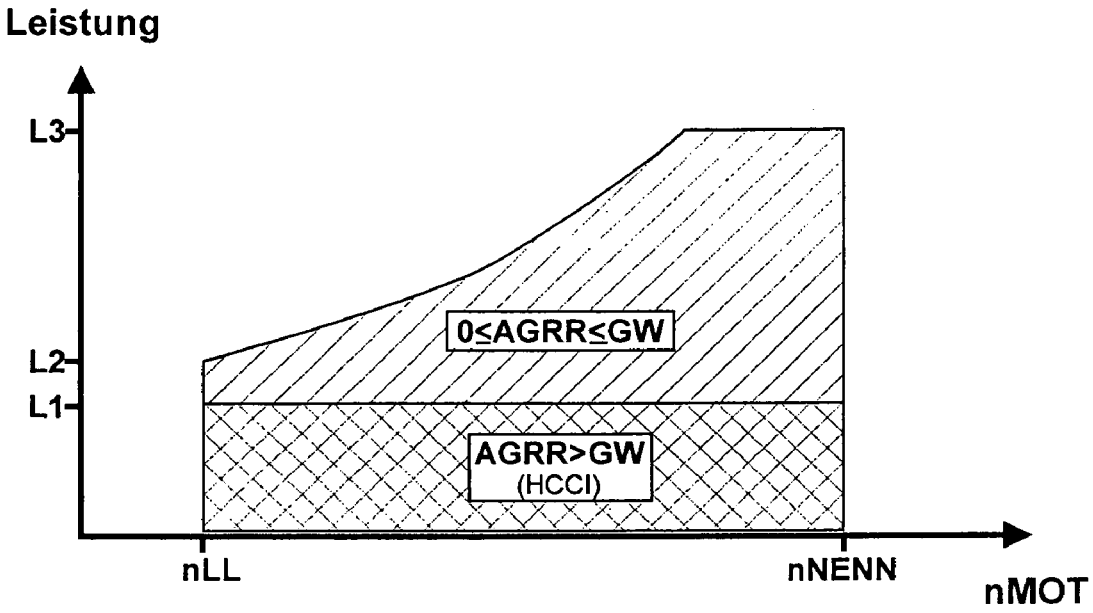
FIG. 3 shows a performance graph.

In a second operating mode, an exhaust gas recirculation rate AGRR in a range larger than zero and smaller than a limit value GW ($0 \leqq AGRR \leqq GW$) is set. The limit value GW is determined by the ratio of the number of cylinders of the second cylinder group 7 and the total number of cylinders. For the example shown in FIG. 1, therefore the limit value is 19%. An exhaust gas recirculation rate AGRR larger than zero and smaller than the limit value GW is set when the internal combustion engine 1 is operating in a predetermined power output and speed range. In FIG. 3, this range is indicated by a hatched area with the engine speed corner values nLL and nNENN and the power output corner values L1, L2 and L3. In the second operating mode, the second control device 14 is deactivated so that the exhaust gas can flow without restriction from the first section 9 of the exhaust gas collection line 8A to the turbine 4A of the exhaust gas turbocharger 2A. The third control device 15 is activated so that the exhaust gas can flow, without restriction, from the second section 10 of the exhaust gas collection line 8A via the exhaust gas recirculation line 11 to the charge air lines 5A and 5B. The first control device 12 is actuated based on a control procedure determined by the performance graph. The exhaust gas volume flow into the first section 9 is consequently controlled by the control device 12 whereby also the exhaust gas recirculation flow volume is controlled.

In a third mode of operation, the so-called HCCI (Homogeneous Charge Compression Ignition) operation an exhaust gas recirculation rate AGRR larger than the limit value GW is set by the electronic engine control unit. In the HCCI operating mode, an exhaust gas recirculation rate of up to 50% is set. In FIG. 3, the HCCI operation is indicated by cross-hatching below the power output L1. In the third mode of operation, the second control device 14 is activated, that is closed, so that the first exhaust gas line 13 is blocked and no exhaust gas can flow from the first section 9 of the exhaust gas collection line 8A to the turbine 4A of the exhaust gas turbocharger 2A. The first control device 12 is operated by a performance graph based control. By means of the control device 12, the exhaust gas volume flow from the first section 9 into the second section 10 of the exhaust gas collection line 8A is controlled. The first cylinder group 6 therefore contributes to the exhaust gas recirculation rate in accordance with the setting of the first control device 12. The third control device 15 is activated whereby the exhaust gas can flow without restriction from the exhaust gas recirculation line 11 to the charge air supply lines 5A and 5B.

FIG. 1 includes a dashed line RM-RM. Above this separation line RM-RM—in accordance with FIG. 1—those components are shown which are used if the invention is applied to an in-line internal combustion engine instead of an engine with a V-type cylinder arrangement, these are the following components: The exhaust gas turbocharger 2A with the compressor 3A and the turbine 4A, the charge air cooler 18, the charge air supply line 5A, the first cylinder group 6 with the cylinders A1 to A5, the second cylinder group 7 with the cylinders A6 to A8, the first section 9 and the second section 10 of the exhaust gas collection line 8A with the first control device 12, the first exhaust gas line 13 with the second control device 14, the heat exchanger 23 and the exhaust gas recirculation line 11 including the third control device 15. As far as the operation is concerned, the above description of the three operating modes applies also in this case.

Figure 2:
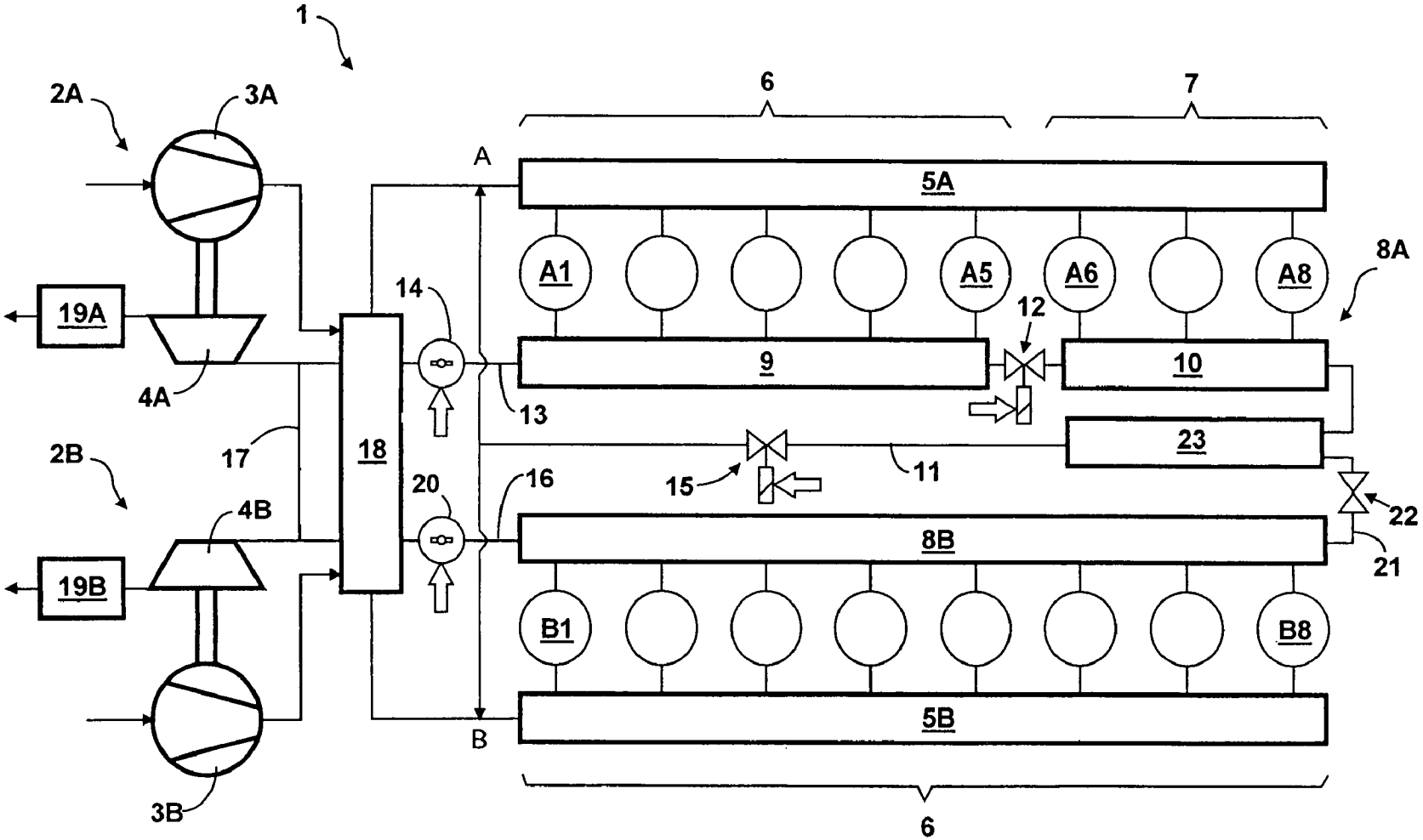
FIG. 2 shows a second embodiment.

The FIG. 2 shows in a block diagram a second embodiment of the invention. In comparison with the block diagram of FIG. 1, a fourth control device 20 and a connecting line 21 with a throttle 22 have been added. By the fourth control device 20, the second exhaust gas line 16 can be throttled so that the exhaust gas of the second cylinder bank with the cylinders B1 to B8 can be recirculated via the connecting line 21 and the throttle 22. In practice, the second control device 14 and the fourth control device 20 are controlled symmetrically. With this embodiment, in the third operating mode, an exhaust gas recirculation rate above 50% can be achieved.

The advantages of the invention are:

The invention can be used in connection with engines having V-type cylinder arrangements as well as in-line cylinder arrangements;

Since in the first operating mode, an exhaust gas recirculation rate of 0% can be established the acceleration behavior of the engine is improved, for example, in connection with an internal combustion engine-power generator application, larger exhaust gas recirculation rates can be set than could be obtained based on the ratio of the number of cylinders of the second cylinder groups and the total number of cylinders;

the thermal load and additional fuel consumption of the internal combustion engine remain in non-critical ranges in spite of high exhaust gas recirculation rates;

with the exhaust gas recirculation rates being adjustable over a large range, a high flexibility is obtained.

What is claimed is:

1. A method of controlling an internal combustion engine (1) comprising first and second groups (6, 7) of cylinders (A1-A8, B1-B8), at least one exhaust gas turbocharger (2A, 2B) with a compressor (3A, 3B) and with a turbine (4A, 4B), a charge air supply line (5A, 5B) for supplying compressed air to the cylinders (A1-A8, B1-B8) of the internal combustion engine (1), the second cylinder group (7) operating in accordance with a spender principle providing exhaust gas for exhaust gas recirculation purposes, an exhaust gas collection line (8A, 8B) connected to the cylinders (A1-A8, B1-B8) and having a first section (9) for the collection of exhaust gas from the first cylinder group (6) and a second section (10) for the collection of exhaust gases from the second cylinder group (7), a first exhaust gas line (13) by which the first section (9, 8A) of the exhaust gas collection line (8A, 8B) is connected to the turbine (4A, 4B), an exhaust gas recirculation line (11) for recirculating exhaust gas from the second section (10) of the gas collection line (8A) to the charge air supply line (5A, 5B) and a first control device (12) for controlling the exhaust gas flow from the first section (9) to the second section (10) of the exhaust gas collection line (8A), said first exhaust gas line (13) including a second control device (14) for controlling the exhaust gas flow to the turbine (4A, 4B) and a third control device (15) arranged in the recirculation line (11) for controlling the exhaust gas recirculation flow to the charge air supply lines (5A, 5B), said method comprising the steps of:

establishing during engine warm-up in first mode of operation an exhaust gas recirculation rate of zero (AGRR=0), establishing during normal engine operation in a predetermined power output and speed range in a second mode of operation an exhaust gas recirculation rate (AGRR) in a range of larger than zero and smaller than a certain limit value (GW) ($0 \leqq AGRR \leqq GW$), wherein the limit value (GW) is determined by the ratio of the cylinder number included in the second cylinder group (7) and number of cylinders of the internal combustion engine, and establishing during HCCI (Homogenous Charge Compression Ignition) operation in a third mode of operation, an exhaust gas recirculation rate (AGRR) which is greater than the limit value (AGRR>GW).

2. The method according to claim 1, wherein, in the first mode of operation, the first control device (12) is deactivated so that the exhaust gas flows without restriction from the second section (10) to the first section (9) of the exhaust gas collection lien (8A), the second control device (14) is deactivated so that the exhaust gas flows without restriction from the first section (9) of the exhaust gas collection line (8A) to the turbine (4A) and the third control device (15) is deactivated so that the exhaust gas recirculation (11) is closed.

3. The method according to claim 1, wherein, in the second mode of operation, the second control device (14) is deactivated so that the exhaust gas flows without restriction from the first section (9) of the exhaust gas collection line (8A) to the turbine (4A), the third control device (15) is activated so that the exhaust gas flows without restriction from the second section (10) of the exhaust gas collection line (8A) to the charge air supply line (5A, 5B) and the first control device (12) is controlled in a performance graph-based operation.

4. The method according to claim 1, wherein, in the third mode of operation, the second control device (14) is activated so as to be closed, the third control device (15) is activated to be open so that the exhaust gas flows without restriction from the exhaust gas recirculation line (11) to the charge air supply line (5A, 5B) and the first control device (12) is controlled in a performance graph-based operation.

5. An internal combustion engine (1) comprising:

a first cylinder bank (A1-A8);

wherein said first cylinder bank (A1-A8) includes cylinders (A1-A5) of a first cylinder group (6) and cylinders (A6-A8) of a second cylinder group (7);

wherein the second cylinder group (7) operates in accordance with a spender principle providing exhaust gas for exhaust gas recirculation purposes, a second cylinder bank (B1-B8);

wherein a second cylinder bank (B1 to B8) includes exclusively cylinders of the first cylinder group (6);

at least one exhaust gas turbocharger (2A, 2B) with a compressor (3A, 3B) and with a turbine (4A, 4B);

a charge air supply line (5A, 5B) for supplying compressed air to the cylinders (A1-A8, B1-B8) of the internal combustion engine (1);

an exhaust gas collection line (8A, 8B) connected to the cylinders (A1-A8, B1-B8) and having a first section (9) for the collection of exhaust gas from the first cylinder group (6) and a second section (10) for the collection of exhaust gases from the second cylinder group (7), a first exhaust gas line (13) by which the first section (9) of the exhaust gas collection line (8A, 8B) is connected to the turbine (4A, 4B);

an exhaust gas recirculation line (11) for recirculating exhaust gas from the second section (10) of the gas collection line (8A) to the charge air supply line (5A, 5B);

a first control device (12) for controlling the exhaust gas flow from the first section (9) to the second section (10) of the exhaust gas collection line (8A);

a second control device (14) for controlling the exhaust gas flow to the turbine (4A, 4B) positioned in said first exhaust gas line (13); and a third control device (15) arranged in the recirculation line (11) for controlling the exhaust gas recirculation flow to the charge air supply lines (5A, 5B).

6. The internal combustion engine according to claim 5, wherein first and second exhaust gas turbochargers (2A, 2B) are provided and the second exhaust gas line (16) is connected to the turbine (4B) of a second exhaust gas turbocharger (2B) and a compensation line (17) extends between the first exhaust gas line (13) and the second exhaust gas line (16) downstream of the second control device (14).

7. The internal combustion engine according to claim 6, wherein the exhaust gas collection line (8B) of the second cylinder bank (B1-B8) is connected to the turbine (4B) of the second exhaust gas turbocharger (2B), a fourth control device (20) is arranged in the second exhaust gas line (16) for controlling the exhaust gas flow to the second turbine (4B) and the exhaust gas collection line (8B) of the second cylinder bank (B1-B8) is in communication with the exhaust gas recirculation line (11) via a connecting line (21) which includes a throttle (22).

8. The internal combustion engine according to claim 5, wherein the exhaust gas recirculation line (11) includes a heat exchanger (23) arranged upstream of the third control device (15).

* * * * *